US007165423B2

(12) United States Patent
Winningham

(10) Patent No.: US 7,165,423 B2
(45) Date of Patent: Jan. 23, 2007

(54) PROCESS FOR EXTRACTING ETHANE AND HEAVIER HYDROCARBONS FROM LNG

(75) Inventor: Horace Gary Winningham, Anderson, TX (US)

(73) Assignees: AMEC Paragon, Inc., Houston, TX (US); Pi Technology Associates, Inc., Anderson, TX (US)

( * ) Notice: Subject to any disclaimer, the term of this patent is extended or adjusted under 35 U.S.C. 154(b) by 201 days.

(21) Appl. No.: 11/012,517

(22) Filed: Dec. 15, 2004

(65) Prior Publication Data

US 2006/0042312 A1 Mar. 2, 2006

Related U.S. Application Data

(60) Provisional application No. 60/605,182, filed on Aug. 27, 2004.

(51) Int. Cl.
*F25J 3/00* (2006.01)

(52) U.S. Cl. ..... 62/620

(58) Field of Classification Search ..... 62/620, 62/625, 632

See application file for complete search history.

(56) References Cited

U.S. PATENT DOCUMENTS 3,405,530 A * 10/1968 Denahan et al. ..... 62/630
3,420,068 A * 1/1969 Petit ..... 62/623
3,524,897 A * 8/1970 Kniel ..... 585/634
5,114,451 A 5/1992 Rambo et al.
5,402,645 A 4/1995 Johnson et al.
5,561,988 A 10/1996 Mehra
5,588,308 A 12/1996 Daugherty et al.
5,687,584 A 11/1997 Mehra
5,953,935 A 9/1999 Sorensen
6,604,380 B1 8/2003 Reddick et al.
6,964,181 B1 * 11/2005 Milios et al. ..... 62/620
2005/0066686 A1 3/2005 Wilkinson et al.
2005/0155381 A1 * 7/2005 Yang et al. ..... 62/620
2005/0268649 A1 * 12/2005 Wilkinson et al. ..... 62/613
2006/0000234 A1 1/2006 Cuellar et al.

* cited by examiner

*Primary Examiner*—William C. Doerrier
(74) *Attorney, Agent, or Firm*—Mark A. Oathout

(57) ABSTRACT

A process for the extraction and recovery of ethane and heavier hydrocarbons (C2+) from LNG. The process covered by this patent maximizes the utilization of the beneficial cryogenic thermal properties of the LNG to extract and recover C2+ form the LNG using a unique arrangement of heat exchange equipment, a cryogenic fractionation column and processing parameters that essentially eliminates (or greatly reduces) the need for gas compression equipment minimizing capital cost, fuel consumption and electrical power requirements.

This invention may be used for one or more of the following purposes:

to condition LNG so that send-out gas delivered from an LNG receiving and regasification terminal meets commercial natural gas quality specifications;

to condition LNG to make Lean LNG that meets fuel quality specifications and standards required by LNG powered vehicles and other LNG fueled equipment;

to condition LNG to make Lean LNG so that it can be used to make CNG meeting specifications and standards for commercial CNG fuel;

to recover ethane, propane and/or other hydrocarbons heavier then methane from LNG for revenue enhancement, profit or other commercial reasons.

8 Claims, 1 Drawing Sheet

PROCESS FOR EXTRACTING ETHANE AND HEAVIER HYDROCARBONS FROM LNG

CROSS-REFERENCE TO RELATED APPLICATIONS

This application claims the benefit of U.S. provisional application No. 60/605,182 filed Aug. 27, 2004.

FEDERALLY SPONSORED RESEARCH OR DEVELOPMENT

Not applicable.

Reference to Listing, Tables or Compact Disk Appendix

Not applicable.

BACKGROUND OF THE INVENTION

Natural gas is a clean-burning hydrocarbon fuel that produces less "greenhouse gases" upon total combustion than that produced from combustion of heavier hydrocarbons such as gasoline, diesel, fuel oil and coal. As a result, natural gas has been identified as an "environmentally friendly" fuel. In recent years, demand for natural gas has been outpacing wellhead supplies that are available for direct connection and delivery into the gas pipeline transport and distribution systems throughout the world, and particularly so within the United States and Europe. As a result, natural gas marketers, pipeline transporters, distributors and power utilities are turning to Liquefied Natural Gas (LNG) to supplement their traditional natural gas supply. Pacific Rim demand for LNG is also increasing at a remarkable rate with accelerating LNG demand projected for Korea, Japan, China and India.

LNG is immerging as an attractive alternative fuel for the transportation and vehicle fuel markets. New technology and government-sponsored programs have helped LNG to become a viable alternative to the more conventional forms of fuel. Both LNG and CNG are anticipated to capture a larger share of this market in the next decade displacing gasoline and diesel fuels. LNG is primarily liquefied methane containing varying quantities of ethane, propane and butanes with trace quantities of pentanes and heavier hydrocarbon components. When stored or transported at or near atmospheric pressure, LNG is a very cold liquid with temperatures ranging between −245° F. to −265° F. dependent upon its composition.

Certain commercial quality specifications must be met when LNG enters the commercial marketplace. Natural gas pipeline and power utility companies, for example, specify in their commercial contracts that natural gas delivered into their facilities must comply with heating value or in some cases, Wobbie Index quality specifications as well as hydrocarbon dew point parameters. When LNG is distributed and used as fuel to power busses, fleet vehicles, private vehicles or other equipment, it must comply with certain quality specifications to assure the characteristics of the fuel yields clean, complete and total combustion in the customer's engine. LNG can also serve as a source of natural gas for making Compressed Natural Gas (CNG) used in the fuels market and when this is the case, CNG quality specification will apply to the LNG.

Some LNG sources contain more ethane and heavier hydrocarbons than others depending on the composition of the natural gas used in making the LNG. Depending upon the quantity of ethane and heavier hydrocarbons contained in the LNG, the LNG may have to be processed and conditioned to reduce the ethane and heavier hydrocarbon content in order to meet the specific commercial quality specifications for its use.

From time to time, the liquid product price of ethane, propane, butanes and heavier hydrocarbon reflects a premium over that which would be realized if left in the LNG and sold at prevailing natural gas prices. Therefore, extraction of these products from LNG can be commercially attractive improving the overall revenue realization of the LNG source.

Ethane and heavier hydrocarbons have for many years been extracted and recovered from raw natural gas produced from gas wells and produced in association with crude oil production. Gas processing facilities of various designs and configurations including the application of turbo-expanders, mechanical refrigeration, lean oil absorption, adsorption using desiccants and combinations thereof have been used for this purpose. The most common prior technology for recovery of ethane and heavier hydrocarbons (NGL) from LNG is based upon the concept of pumping the LNG to high pressure, vaporizing the LNG and processing the resulting gas using traditional gas processing techniques with the conventional cryogenic turbo-expander and/or cryogenic J-T expansion processes being the most widely used. This practice does not capture and fully utilize the benefits of the cryogenic conditions available from the LNG.

There are three other known processes for recovery of NGL from LNG that are disclosed in U.S. Pat. Nos. 5,114,451, 5,588,308, and 6,604,380 that makes some use of the beneficial cryogenic conditions and properties of LNG.

U.S. Pat. No. 5,114,451 discloses a process for recovery of NGL from LNG where the LNG feed is warmed by cross exchange of heat from a warm gas stream being a recompressed overhead recycle stream from the fractionation unit (commonly referred to as a demethanizer). The NGL product is recovered as a liquid product from the bottom of the demethanizer. The send-out gas (the overhead vapor from the demethanizer), however, must be heated and compressed prior to delivery to the pipeline system. Compression and heating adds to the capital costs and fuel consumption of the process.

U.S. Pat. No. 5,588,308 discloses a process that recovers NGL by cooling and partial condensation of purified natural gas feed wherein a portion of the necessary feed cooling and condensation duty is provided by expansion and vaporization of condensed feed liquid after methane stripping, thereby yielding an NGL product in gaseous form. In the market place, NGL is sold and transported as a liquid product. Additional cooling and compression are required to make a liquid NGL product that adds to the capital cost and fuel consumption for making the final NGL product.

U.S. Pat. No. 6,604,380 discloses a process for recovery of NGL from LNG using a portion of the LNG feed, without heating or other treatment, as an external reflux during separation. A fractionation column is used in the process to recover an NGL liquid product from the bottom of the column with the overhead vapor product being the methane-rich residue gas which is subsequently compressed, re-liquefied, pumped, vaporized and sent to the receiving pipeline. This process, however, requires that the entire overhead vapor product stream from the fractionation column be compressed by a low head compressor in order to re-liquefy. The compression required for the process is a low head (75 to 115 psi), but requires the entire send-out gas stream to be compressed. If, for example, the facility is designed for a capacity to handle say 1,000 million standard cubic feet per day (MMscfd) of send-out gas, the compression brake horsepower (Bhp) could be on the order of 5 to 7 Bhp/MMscfd requiring a 5,000 Bhp to 7,000 Bhp compressor. This compressor and its associated fuel consumption add to the capital cost and operating expense for the facility.

BRIEF SUMMARY OF THE INVENTION

Development and optimization of new processing technology is the "cornerstone" for the continued growth and expansion of the LNG industry. The industry needs a more efficient process to extract and remove ethane and heavier hydrocarbons (NGL) from LNG. The disclosed system(s) and method(s) provide industry with a step forward in improving technology for efficiently extracting NGL products from LNG.

The process disclosed reflects a significant improvement over prior patents and existing technology for the extraction of ethane and heavier hydrocarbons from LNG. The process of the disclosed embodiment(s) will reduce capital costs and improve fuel efficiency when compared to current practice from existing patented technology. The process of the embodiment(s) maximizes the utilization of the beneficial cryogenic thermal properties of the LNG using a unique arrangement of heat exchange equipment and processing parameters that essentially eliminates (or greatly reduces) the need for gas compression equipment required in other patented technology of this field. Elimination or minimization of gas compression equipment minimizes the capital cost and minimizes fuel consumption or electrical power consumption, which reduces operating expenses. Use of our process in a facility designed to handle 1,000 MMscfd of send-out gas will require only 150 to 550 horsepower of gas compression when processing LNG rich in ethane and heavier hydrocarbons. For leaner LNG compositions our gas compression horsepower increases, but still remains less than 1,000 horsepower for a 1,000 MMscfd send-out capacity which compares to the 5,000 to 7,000 horsepower required by the leading competitor process disclosed in U.S. Pat. No. 6,604,380 referenced herein. Translating this comparison into economic terms, our process would result in a current-day capital cost savings ranging between $4.5 to $5.5 million and our fuel consumption savings would range between 335,000 to 480,000 MMBtus per annum based on a throughput capacity of 1,000 MMscfd. At current natural gas prices (assume $5.00/MMBtu average), our fuel expense savings would range between $1.7 to $2.4 million per annum.

The disclosed embodiment(s) relate to a process for removing ethane and/or heavier hydrocarbons (NGL) from LNG at any facility receiving, storing, shipping, distributing, or vaporizing LNG. For purposes of this application, LNG containing more that 2.5 mole % and less than 25.0 mole % ethane and heavier hydrocarbons is defined to mean "Rich LNG". After extraction of ethane and/or heavier hydrocarbons, the residual methane-rich product after is defined to mean "Lean LNG". The ethane and/or heavier hydrocarbons extracted from the Rich LNG are defined to mean "NGL Product". Ethane and heavier hydrocarbons are referred to herein as "C2+". Propane and heavier hydrocarbons are referred to herein as "C3+".

The disclosed embodiment(s) specifically relate to a process for extraction and removal of C2+ or C3+ from Rich LNG for one or more of the following purposes:

a) To condition Rich LNG so that send-out gas delivered from an LNG receiving and regasification terminal meets commercial natural gas quality specifications.
b) To condition Rich LNG to make Lean LNG that meets fuel quality specifications and standards required by LNG powered vehicles and other LNG fueled equipment.
c) To condition Rich LNG to make Lean LNG so that it can be used to make CNG meeting specifications and standards for commercial CNG fuel.
d) To recover ethane, propane and/or other hydrocarbons heavier than methane from Rich LNG for revenue enhancement, profit or other commercial reasons.

Our process has the flexibility to either operate in a "high ethane extraction" or a "low ethane extraction" mode. When operating in the "high ethane extraction" mode, ethane recovery levels for our process ranges between 92% to 80% with propane recovery ranging between 99% and 90%. When operating in the "low ethane extraction" mode, ethane recovery is only 1% to 2% while propane recovery ranges between 95% to 80%. This feature of the process provides the flexibility to leave essentially all or any portion of the ethane in the Lean LNG stream if commercial specifications, pricing and other economic factors dictate the need for such operation.

The disclosed embodiment(s) utilize several processing steps to extract and remove ethane and heavier hydrocarbons from Rich LNG that are disclosed in the Detailed Description section below. Briefly stated, low-pressure Rich LNG is pumped to processing pressure (380 psig to 550 psig), pre-heated, vaporized and fractionated in a refluxed cryogenic fractionation column equipped with one side reboiler and a main reboiler at the bottom. A split-stream of the pre-heated LNG liquid is used to provide cold reflux to the cryogenic fractionation column. The balance of the pre-heated LNG feed is vaporized and fed to the fractionation column as a vapor stream with entry into the column at 5 to 10 theoretical equilibrium stages below the top. The cryogenic fractionation column requires 15 to 20 theoretical equilibrium stages and is designed to yield a liquid hydrocarbon product from the bottom and a cold methane-rich gas product from the top. The bottom liquid product is the NGL Product.

Flexibility is embodied into our cryogenic fractionation column design to produce either a demethanized or a deethanized NGL Product. The operating parameters of the cryogenic fractionation column and associated equipment (i.e. operating pressure, feed temperatures, reflux/feed split, bottom temperature, etc.) may be adjusted and controlled within our process such that both the Lean LNG and NGL Product each conform to their respective commercial specification requirements.

The cold gas product from the column overhead (lean in ethane and heavier hydrocarbons) is re-liquefied by cross exchange with the Rich LNG during the pre-heating step. This re-liquefied cold gas overhead product is the Lean LNG. Depending on the LNG composition, a small fraction of the cold gas product may not condense which is referred to herein as the "Tail Gas".

A small cryogenic compressor is required to compress the Tail Gas that is not re-liquefied by the cross exchange pre-heat step to gas pipeline send-out pressure. If the overall facility has a need for fuel gas, the Tail Gas can be used as a source of fuel, which reduces the amount of gas requiring compression. The volume of Tail Gas for our process is very small ranging between 0 to 5 mole % of the total gas throughput capacity when the Rich LNG feed composition contains more than 8 mole % C2+. Lower C2+ content in the Rich LNG feed causes the Tail Gas fraction in our process to increase. For feeds containing only 2.5 mole % C2+, Tail Gas for our process would be as high as 7 to 10 mole % of the total gas throughput capacity.

The Lean LNG is pumped to gas pipeline send-out pressure and the compressed Tail Gas is then recombined with the Lean LNG at send-out pressure (typically 1,000 to 1,100 psig but could be higher or lower). Upon mixing with the Lean LNG at send-out pressure, the compressed Tail Gas is absorbed and condenses into the liquid LNG phase. The resulting Lean LNG stream is then vaporized and heated for delivery into the natural gas pipeline.

Process operating set points can be adjusted as required to make Lean LNG conforming with the quality specifications for gas pipeline market delivery, for use as LNG fuel in the LNG vehicle fuel market, or for use in making high pressure CNG fuel. When using this process for serving the LNG vehicle fuel market or any other local market requiring Lean LNG at or near atmospheric pressure, additional equipment is required to handle and re-liquefy flash gas that will evolve when the pressure of the Lean LNG is reduced down to atmospheric storage pressure.

BRIEF DESCRIPTION OF THE DRAWINGS

The disclosed embodiment(s) and their advantages will be better understood by referring to following drawing.

Figure 1:
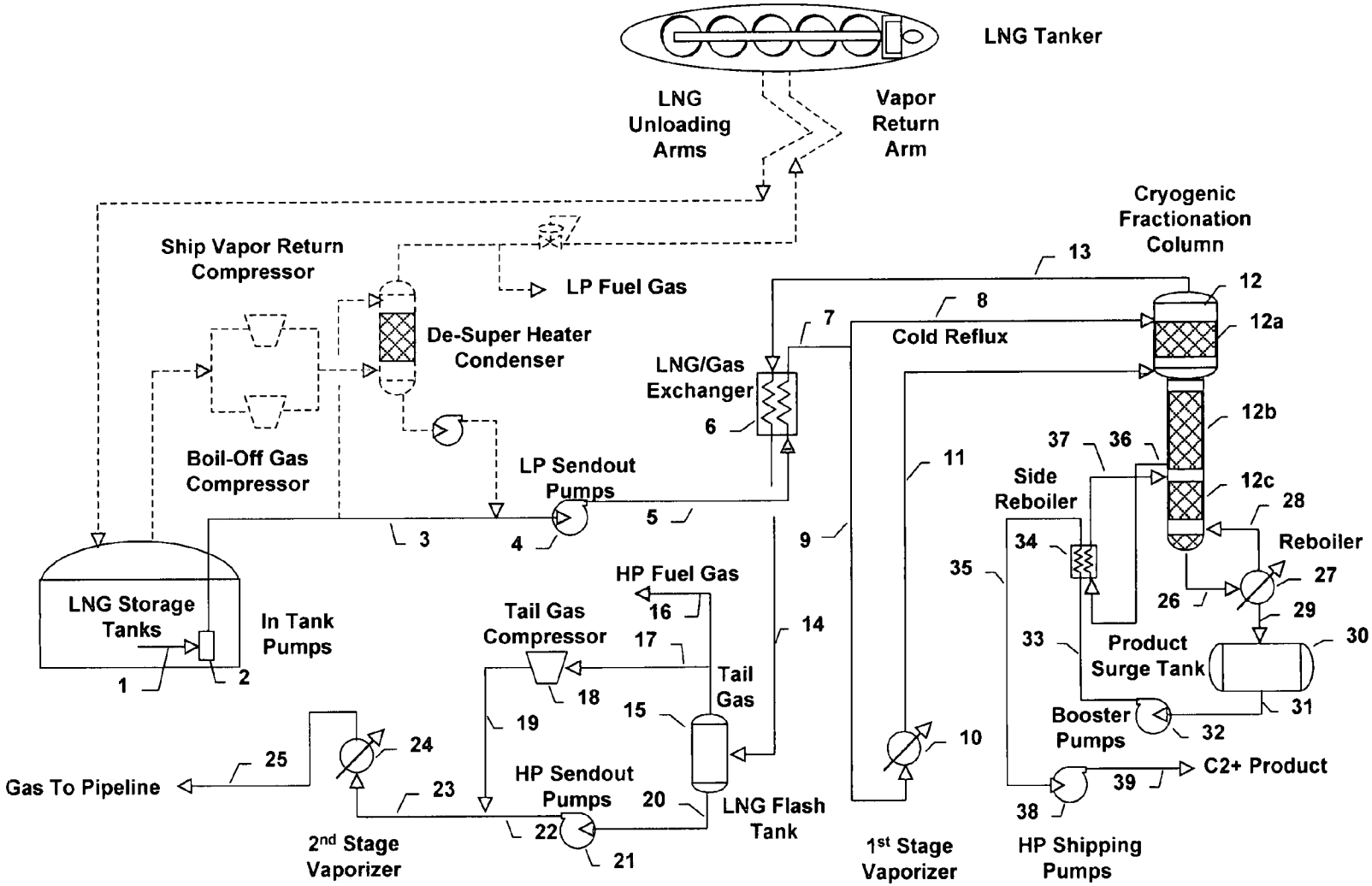
FIG. 1 is a schematic flow diagram of one embodiment of this process.

The drawing illustrates a specific embodiment for practicing this process. The drawing is not intended to exclude from the scope of the invention other embodiments that are the result of normal and expected modifications of the specific embodiment disclosed to accommodate the application and practice for compositions, commercial specifications, and operating conditions that may differ from that illustrated in the drawing.

DETAILED DESCRIPTION OF THE INVENTION

One embodiment of this process is for conditioning Rich LNG so that send-out gas delivered from an LNG receiving and regasification terminal meets commercial natural gas quality specifications as illustrated in FIG. 1. The following design description is based on a C2+ content in the Rich LNG feed ranging between 25.0 to 2.5 mole % operating in the "high ethane extraction" mode. Processing conditions reported are given as a range, reflecting the compositional range defined for this process.

Stream 1 (Rich LNG from the LNG Storage Tanks) enters pump 2 (the In-Tank Pumps) where it is pumped to a pressure of approximately 100 psig discharging from the pump 2 as stream 3.

FIG. 1 shows a portion of stream 3 being sent to the De-Super Heater Condenser system with a return back to stream 3. The Boil-Off Gas Compressor, Ship Vapor Return Compressor and De-Super Heater Condenser system shown in FIG. 1 are not claimed as an embodiment of this invention and therefore, are not discussed.

Stream 3 is fed to pump 4 (the LP Sendout Pumps) where it is pumped and boosted to a processing pressure ranging between 380 to 550 psig discharging from the pump 4 as stream 5.

Stream 5 (the Rich LNG discharge from pump 4) is then fed to heat exchanger 6 (the LNG/Gas Exchanger) where it is heated to a temperature near its bubble point temperature and exits from the heat exchanger 6 as stream 7. The source of heat for heat exchanger 6 (the LNG/Gas Exchanger) is supplied by cross exchange with stream 13 being the overhead cold gas product stream from column 12 (the Cryogenic Fractionation Column). Heat exchanger 6 (the LNG/Gas Exchanger) performs dual services in that it heats stream 5 (the Rich LNG stream) up to near bubble point temperature (stream 7) and re-liquefies essentially all (100% to 90%) of stream 13 (the overhead cold gas product from the Cryogenic Fractionation Column) which exits as stream 14.

Heat exchanger 6 (the LNG/Gas Exchanger) has a relatively large heat transfer duty and requires a small minimum approach temperature to achieve the efficiency required in this process. The design performance specification for heat exchanger 6 (the LNG/Gas Exchanger) requires a minimum approach temperature of approximately 3° F. to 5° F. between stream 13 and stream 7 to maximize the re-liquefaction of stream 14 exiting the exchanger. A shell and tube type exchanger could potentially be used for this service, but it would be quite large and relatively expensive. A more cost-effective design is achieved by using either a brazed aluminum plate-finned exchanger or a printed circuit type exchanger for this service.

Stream 7 from heat exchanger 6 (the LNG/Gas Exchanger) is split into two streams (stream 8 and stream 9).

Stream 8 serves as cold reflux to column 12 (the Cryogenic Fractionation Column) and is maintained within a range of 65% to 45% of the total flow rate of stream 7 using ratio flow control instrumentation. The flow rate ratio of stream 8 to total flow of stream 7 is one of the parameters used in this process to control the level for ethane extraction and recovery from the Rich LNG. In general terms, biasing higher flow rates to stream 8 acts to increase ethane extraction from the Rich LNG while lowering flow rate ratio of stream 8 acts to reduce ethane extraction. Selection of the flow rate ratio set point for stream 8 is dependent upon the level of ethane extraction desired for the specific operating performance needed from the facility and the composition of the Rich LNG.

Stream 9 is fed to vaporizer 10 (the 1$^{st}$ Stage Vaporizer) where it is vaporized and heated creating stream 11, which is then fed to column 12 (the Cryogenic Fractionation Column). Stream 11 exiting from vaporizer 10 (the 1$^{st}$ Stage Vaporizer) is at a temperature ranging between 30 to 70° F. and is essentially all vapor with no liquid. Stream 11 enters column 12 at an entry point located four to eight theoretical equilibrium stages below the top of the column 12. Vaporizer 10 (the 1$^{st}$ Stage Vaporizer) can be either an open rack vaporizer (ORV) using seawater as the warming fluid or a submerged combustion vaporizer (SCV) using gas-air combustion in a submerged water bath for heat or any other types of heater or exchanger combinations which might utilize process heat or waste heat available at the site. If a suitable source of seawater is available, the use of an open rack vaporizer is recommended which significantly improves the overall fuel efficiency of this process.

Column 12 (the Cryogenic Fractionation Column) is a reboiled fractionation column designed to yield an NGL Product from the bottom and a cold gas overhead product having a high methane content from the top. Column 12 (the Cryogenic Fractionation Column) is comprised of three sections and operates at a nominal pressure of 350 to 520 psig. The top section requires a larger diameter than the two bottom sections since the top section has a relatively high vapor loading of the combined column feed (stream 8 plus stream 11). Each section contains internal equipment (not shown) to achieve equilibrium stage heat and mass transfer as typically required in fractionation columns. The type of internals might include bubble cap trays, sieve trays, dumped packing, or structured packing. For this service, either dumped packing or structured packing of suitable geometric design with appropriate liquid distributors and packing supports would likely provide better mass transfer for the cryogenic fluid traffic within the column. Vendors and manufacturer specializing in fractionation column internals should be consulted to determine the optimum selection for the internals needed in this service.

Process calculations indicate that a total of sixteen theoretical equilibrium stages are needed in column 12 (the Cryogenic Fractionation Column) divided between the three sections of the column as follows: five theoretical stages in the top section, seven theoretical stages in the middle section and four theoretical stages in the bottom section. The total number of theoretical equilibrium stages, however, could range between fifteen to twenty stages depending upon the Rich LNG composition and specific recovery performance needed. Variance in the actual design of column 12 will be required depending upon a number of factors including composition of the Rich LNG and the desire range of extraction levels for ethane, for example.

Stream 8 is fed to the top of column 12 (the Cryogenic Fractionation Column) serving as cold liquid reflux to the column. Stream 8 liquid is uniformly distributed over the top packed section 12*a* by means of an internal distributor (not shown) and flows downward through the top section 12*a* wetting the packing internals and contacting the vapor traffic flowing upward. Stream 11, which is essentially all vapor, enters column 12 between the top section 12*a* and middle section 12*b*. The vapor of stream 11 combines with other vapor flowing upward from the middle packed section 12*b* of the column 12 and the combined vapors flow upward through the top packed section 12*a* contacting the cold liquid reflux which is flowing downward. The cold reflux liquid acts to absorb and condense ethane and heavier hydrocarbons from the vapor flowing upward through the top packed section 12*a*. Vapor from the top packed section 12*a* exits column 12 (the Cryogenic Fractionation Column) as stream 13 (the overhead cold gas product).

Liquid (if any) in stream 11 after entry into column 12, combines with the liquids flowing downward from the top packed section 12*a* and the combined liquids are evenly distributed over the middle packed section 12*b* by means of an internal distributor (not shown) located on top of the middle packed section 12*b*. The evenly distributed liquids continue flowing downward through the middle packed section 12*b* wetting the packing internals and contacting the vapors flowing upward. In so doing, a distillation operation is established within the column 12 with the lighter, more volatile components (i.e. methane and nitrogen) in the liquids being transferred into the vapor phase and the heavier, less volatile components (i.e. ethane and heavier hydrocarbons) in the vapors being transferred into the liquid phase.

At the bottom of the middle packed section 12*b* of column 12, a liquid draw-off tray (not shown) is required. Liquids leaving from the bottom of middle packed section 12*b* are collected in this draw-off tray and exit column 12 (the Cryogenic Fractionation Column) as stream 36. Exchanger 34 (the Side Reboiler) heats and partially vaporizes stream 36 that is then fed back to column 12 as stream 37 entering onto the liquid distributor (not shown) for the bottom packed section 12*c*.

The liquids from this distributor are evenly distributed over the bottom packed section 12*c* and flow downward through the bottom packed section 12*c* wetting the packing internals and contacting the vapors flowing upward. In so doing, a distillation operation is again established within the column 12 with the lighter, more volatile components (i.e. nitrogen, methane and small amounts of ethane) in the liquids being transferred into the vapor phase and the heavier, less volatile components (i.e. ethane and heavier hydrocarbons) in the vapors being transferred into the liquid phase. The liquid from the bottom packed section 12*c* exit column 12 (the Cryogenic Fractionation Column) as stream 26 and is fed to heat exchanger 27 (the Reboiler).

Heat exchanger 27 (the Reboiler) heats and partially vaporizes stream 26. The vaporized portion of stream 26 from heat exchanger 27 (the Reboiler) is returned to column 12 (the Cryogenic Fractionation Column) as stream 28 entering the column below the bottom packed section 12*c* of the column 12. The liquid portion of stream 26 exits heat exchanger 27 (the Reboiler) as stream 29 (the NGL Product) and is sent to tank 30 (an optional NGL Product Surge Tank).

Tank 30 (which is optional) is a surge tank to hold an inventory of NGL product for feeding pump 32 and to provide operating flexibility. Stream 29, the NGL Product containing a mixture of ethane and heavier hydrocarbons and a small methane fraction (usually less than 1 mole % methane) exits from tank 30 (the NGL Product Surge Tank) as stream 31 and is optionally pumped by pump 32 (the NGL Booster Pumps) boosting the pressure approximately 50 psig discharging from the pump as stream 33. Depending on the specific application, alternate arrangement of storage and pumping may be utilized.

Stream 33 is then cooled in heat exchanger 34 (the Side Reboiler) exiting as stream 35. Heat exchanger 34 (the Side Reboiler) performs a dual service and improves the fuel efficiency for the overall process. Thermal energy recovered from stream 33 is used to provide side reboiling heat as stream 37 into column 12 (the Cryogenic Fractionation Column) between the middle 12*b* and bottom 12*c* packed sections and correspondingly, stream 35 (the NGL product stream) is cooled. Heat recovery from stream 33 in exchanger 34 (the Side Reboiler) reduces the heat load of exchanger 27 (the Reboiler) which in turn reduces the overall process utility heating requirement resulting in an overall reduction in the amount of fuel required to operate the system. The heat recovered from the NGL Product from exchanger 34 (the Side Reboiler) reduced the process utility heating system load by 15% to 35% when the C2+ content of the Rich LNG is high (C2+>10 mole %). If the C2+ content of the Rich LNG is low (C2+<10 mole %), process utility heating system load is reduced by 2% to 15%. In certain design scenarios and marketing options, an auxiliary cooler may be required for cooling the NGL Product prior to shipping or storage. The auxiliary NGL Product cooler, which has not been shown in FIG. 1, would be located downstream of exchanger 34 (the Side Reboiler) to cool stream 35.

Stream 35 (the cooled NGL Product stream leaving the Side Reboiler) is then pumped to pipeline shipping pressure by pump 38 (the HP Shipping Pumps), metered and delivered into the NGL Product pipeline. Depending on the specific application, alternate arrangement of storage and pumping may be utilized. Other methods of transportation for moving the NGL product can be substituted for the pipeline transport method illustrated in FIG. 1 including, but not limited to truck, rail and marine (refrigerated cargo ships). Such alternatives would not require a HP Shipping Pump 38.

Stream 14 being the re-liquefied "Lean" LNG exiting from heat exchanger 6 (the LNG/Gas Exchanger) may contain a small fraction of uncondensed gas (0% to 10% on a molar basis) referred to as Tail Gas. Stream 14 is sent to tank 15 (the LNG Flash Tank) to separate any uncondensed Tail Gas from the Lean LNG. Stream 20 (the Lean LNG) from tank 15 is pumped to pipeline send-out pressure by pump 21 (the HP Sendout Pumps) discharging from the pump 21 as stream 22.

The uncondensed Tail Gas exits from tank 15 as stream 16 and stream 17. Stream 16 represents the portion of the uncondensed Tail Gas from tank 15 used as a source of high pressure fuel gas. Stream 17 represents the portion of uncondensed Tail Gas from tank 15 that is in excess of that used for high pressure fuel gas. Stream 17 (the Tail Gas) is compressed by compressor 18 (the Tail Gas Compressor) to pipeline send-out pressure discharging from the compressor as stream 19. Under certain conditions depending on the composition of the reliquified LNG, stream 14 may be totally condensed and compressor 18 may not be required.

Stream 19 (the compressed Tail Gas) is recombined with stream 22. The mixing of gas stream 19 (the compressed Tail Gas) with the liquid stream 22 (the Lean LNG at send-out pressure) causes stream 19 (the compressed Tail Gas) to be condensed and absorbed into the Lean LNG resulting in stream 23 which is 100% liquid. Stream 23 (the Lean LNG containing the re-liquefied Tail Gas) is then vaporized in vaporizer 24 (the $2^{nd}$ Stage Vaporizer) exiting as stream 25 (the pipeline send-out gas) which is then metered and delivered to the gas pipeline. Vaporizer 24 (the $2^{nd}$ Stage Vaporizer) can be either an open rack vaporizer (ORV) using seawater as the warming fluid or a submerged combustion vaporizer (SCV) using gas-air combustion in a submerged water bath for heat or any other types of heater or exchanger combinations which utilize process heat or waste heat available at the site. If a suitable source of seawater is available, the use of an open rack vaporizer (ORV) is recommended which significantly improves the overall fuel efficiency of this process.

EXAMPLE

One process embodiment as illustrated in FIG. 1 was modeled using a commercially available process simulation program called HYSYS (available from AspenTech of Calgary, Alberta Canada). HYSYS is commonly used by the oil and natural gas industry to evaluate and design process systems of this type. A wide range of LNG feed compositions were evaluated using the HYSYS model of our process. The HYSYS model calculation results for our process are summarized in Tables 1 and 2 below for one of the LNG feed compositions evaluated. The Example results given in Tables 1 and 2 are intended to illustrate performance of our process operating in the "High Ethane Recovery" mode for a typical LNG feed composition. Stream numbering in Tables 1 and 2 coincide with those illustrated in FIG. 1. Any person trained and skilled in the technical art of process engineering, particularly one having the benefit of these disclosed embodiments, will recognize the possibility for variations to the process conditions disclosed in Tables 1 and 2 from application to application. For example, the combination of temperatures, pressures, and flow rates within our process will be different than that illustrated in Table 2 depending upon the LNG feed composition and flow rate, NGL product specification, send-out gas specifications, and desired recovery levels of the ethane and heavier hydrocarbons. The process disclosed by this patent is extremely flexible and has been confirmed by HYSYS modeling calculations to perform satisfactory over a wide range of LNG feed compositions, product specifications and desired recovery levels of C2+. The Example results given in Tables 1 and 2 shall not be used to limit or restrict the scope of this invention but shall serve only to illustrate processing conditions of the embodiments of this invention for a hypothetical application.

TABLE 1

Compositions and NGL Recovery Levels

| Component | LNG Feed Stream 1 Mole % | Fuel Gas Stream 16 Mole % | Send-Out Gas Stream 25 Mole % | NGL Product Stream 39 Mole % | NGL % Recovery |
|---|---|---|---|---|---|
| Nitrogen | 0.131 | 0.404 | 0.145 | 0.000 | 0.00 |
| Carbon Dioxide | 0.000 | 0.000 | 0.000 | 0.000 | 0.00 |
| Methane | 89.066 | 99.466 | 98.926 | 2.299 | 0.26 |
| Ethane | 7.035 | 0.128 | 0.865 | 61.352 | 89.05 |
| Propane | 2.412 | 0.002 | 0.057 | 23.124 | 97.89 |
| I-Butane | 0.402 | 0.000 | 0.003 | 3.911 | 99.34 |
| N-Butane | 0.804 | 0.000 | 0.004 | 7.840 | 99.56 |
| I-Pentane | 0.080 | 0.000 | 0.000 | 0.786 | 100.00 |
| N-Pentane | 0.070 | 0.000 | 0.000 | 0.688 | 100.00 |
| Total | 100.000 | 100.000 | 100.000 | 100.000 | N/A |

TABLE 2

Stream Conditions and Flow rates

| Stream Number | Temperature Deg F. | Pressure psia | Flow rate lb moles/hr |
|---|---|---|---|
| 1 | −256 | 15.7 | 47,530 |
| 3 | −255 | 115 | 47,530 |
| 5 | −253 | 485 | 47,530 |
| 7 | −136 | 470 | 47,530 |
| 8 | −136 | 460 | 28,043 |
| 9 | −136 | 470 | 19,487 |
| 11 | 50 | 445 | 19,487 |
| 13 | −133 | 435 | 42,677 |
| 14 | −141 | 430 | 42,677 |
| 16 | −141 | 420 | 255 |
| 17 | −141 | 420 | 385 |
| 19 | −22 | 1150 | 385 |
| 20 | −141 | 430 | 42,037 |
| 22 | −125 | 1150 | 42,037 |
| 23 | −124 | 1150 | 42,422 |
| 25 | 40 | 1115 | 42,422 |
| 26 | 56 | 440 | 8,776 |
| 28 | 81 | 440 | 3,993 |
| 29 | 81 | 440 | 4,853 |
| 31 | 81 | 440 | 4,853 |
| 33 | 84 | 585 | 4,853 |
| 35 | 40 | 565 | 4,853 |
| 36 | −39 | 439 | 8,152 |
| 37 | −17 | 438 | 8,152 |
| 39 | 42 | 1015 | 4,853 |

What is claimed is:

1. A process for extracting and recovering ethane and heavier hydrocarbons (C2+) from a liquefied natural gas (LNG) that reduces or in certain design scenarios completely eliminates the need for gas compression, comprising the steps of:

a) pumping the LNG from near atmospheric pressure up to a pressure ranging between 380 to 550 psig;

b) after said pumping, pre-heating the LNG to near its bubble point temperature by direct cross exchange with a cold methane-rich overhead vapor stream produced from the top of a cryogenic fractionation column claimed in e) below;

c) after said pre-heating, dividing the LNG into two streams with one being called the cold LNG reflux stream and the other being called the residual LNG stream;

d) heating and vaporizing the residual LNG stream to produce a feed gas stream;

e) using a cryogenic fractionation column operating at a pressure ranging between 350 and 520 psig to produce a cold methane-rich overhead vapor stream from the top of the cryogenic fractionation column and a NGL Product stream from the bottom of the cryogenic fractionation column;

f) feeding the cold LNG reflux stream from step c) into the cryogenic fractionation column at an entry point located on the top theoretical equilibrium stage of the cryogenic fractionation column;

g) feeding the feed gas stream from step d) into the cryogenic fractionation column at an entry point into the cryogenic fractionation column located three to eight theoretical equilibrium stages below the top theoretical equilibrium stage of the cryogenic fractionation column;

h) adding heat to the cryogenic fractionation column using at least one heat exchanger having a liquid draw-off and a return connected to the cryogenic fractionation column below the entry point of the feed gas stream and above the bottom equilibrium stage of the cryogenic fractionation column with the source of heat for said heat exchanger(s) being supplied from heat recovered from the NGL Product by direct cross exchange;

i) adding heat to the bottom of the cryogenic fractionation column using another heat exchanger to create boil-up vapors returning to the cryogenic fractionation column and to maintain the bottom temperature in the cryogenic fractionation column at the temperature required to control the NGL Product quality;

j) re-liquefying 90% to 100% of the cold methane-rich overhead vapor stream produced from the top of the cryogenic fractionation column by utilizing refrigeration recovered from the LNG pre-heating step b) by direct cross exchange between the LNG and the cold methane-rich overhead vapor stream using one or more heat exchangers;

k) separating gas from the liquid resulting from step j) into a Tail Gas stream and a Lean LNG stream using gas-liquid separation equipment;

l) using the Tail Gas as a source of supply for a facility fuel gas system;

m) compressing the Tail Gas that is in excess of that used in the facility fuel gas system to the pipeline send-out pressure using a conventional compressor suitable for operating at cryogenic temperatures;

n) pumping the Lean LNG to pipeline send-out pressure and mixing the Lean LNG with the compressed excess Tail Gas at pipeline send-out pressure as a method for re-liquefying and condensing the Tail Gas; and o) vaporizing and heating the Lean LNG containing the re-liquefied excess Tail Gas whereby the resulting gas stream may be delivered to the send-out gas pipeline.

2. The process of claim 1, the vaporization steps d) and o) are further characterized to include use of either conventional open rack LNG vaporizers heated by seawater, conventional submerged combustion LNG vaporizers heated by gas-air combustion in a submerged water bath or any other type of vaporizers or heat exchanger combinations capable of vaporizing LNG in these services.

3. For the process of claim 1, the heat exchanger(s) of step i) further characterized as being supplied with heat from an external heat source including but not limited to steam, heating medium fluid, hot oil, direct firing, warm seawater, waste heat recovery from turbine/engine exhaust combustion gases, electrical heating element, solar energy, or any other source of heat that may be adapted to this service.

4. For the process of claim 1, the heat transfer service required for b), h) and i) further characterized as using either brazed aluminum plate-finned exchanger(s), printed circuit type exchanger(s), shell and tube exchangers or other types of heat exchangers that are capable of achieving minimum approach temperatures of 3° F. to 5° F.

5. Using the process of claim 1 for:

a) conditioning LNG so that send-out gas delivered from an LNG receiving and regasification terminal meets commercial natural gas quality specifications;

b) conditioning LNG to meets fuel quality specifications and standards required by LNG powered vehicles and other LNG fueled equipment;

c) conditioning LNG so that it can be used to make CNG meeting specifications and standards for commercial CNG fuel; and d) processing LNG to recover ethane, propane and/or other hydrocarbons heavier then methane from LNG.

6. Using the process of claim 1 for LNG having varying hydrocarbon compositions with C2+ content ranging from a low of 2.5 mole % C2+ up to a high of 25.0 mole % C2+.

7. Using the process of claim 1 for LNG in a "high ethane recovery mode" with C2+ content ranging from a low of 2.5 mole % C2+ up to a high of 25.0 mole % C2+:

a) achieving ethane recovery ranging from 80% to 92%;

b) achieving propane recovery ranging between 95% and 99%; and c) achieving essentially 100% recovery of hydrocarbons heavier than propane.

8. Using the process of claim 1 for processing LNG in a "low ethane recovery mode" with C2+ content ranging from a low of 2.5 mole % C2+ up to a high of 25.0 mole % C2+ reducing ethane recovery to any desired lower level down to a minimum ethane recovery of 2% by making changes to operating conditions of the cryogenic fractionation column including various combinations of reduced pressure, increasing bottom temperature and changing reflux rate for:

a) achieving propane recovery ranging between 95% and 80%; and b) achieving butanes and heavier hydrocarbon recovery ranging between 99% and 95%.

* * * * *